US007046154B2

(12) United States Patent
Bott et al.

(10) Patent No.: US 7,046,154 B2
(45) Date of Patent: May 16, 2006

(54) FLAME-MONITORING DEVICE

(75) Inventors: Klaus Bott, Durmersheim (DE); Alexander Diebold, Rastatt (DE); Jürgen Hoffmann, Baden-Baden (DE); Reiner Kind, Rastatt (DE)

(73) Assignee: Siemens Building Technologies AG, Zurich (CH)

( * ) Notice: Subject to any disclaimer, the term of this patent is extended or adjusted under 35 U.S.C. 154(b) by 35 days.

(21) Appl. No.: 10/477,005

(22) PCT Filed: May 22, 2002

(86) PCT No.: PCT/IB02/01758

§ 371 (c)(1),
(2), (4) Date: Nov. 6, 2003

(87) PCT Pub. No.: WO02/095295

PCT Pub. Date: Nov. 28, 2002

(65) Prior Publication Data

US 2004/0178915 A1 Sep. 16, 2004

(30) Foreign Application Priority Data

May 25, 2001 (DE) ..... 101 25 574

(51) Int. Cl.
*G08B 17/12* (2006.01)

(52) U.S. Cl. ..... 340/577; 340/587; 431/75

(58) Field of Classification Search ..... 340/579, 340/577, 578, 506, 587; 431/75, 78, 24, 431/25

See application file for complete search history.

(56) References Cited

U.S. PATENT DOCUMENTS

| | | | | |
|---|---|---|---|---|
| 3,378,733 A | 4/1968 | Jensen | ..... | 361/175 |
| 5,899,683 A | 5/1999 | Nolte et al. | ..... | 431/25 |

FOREIGN PATENT DOCUMENTS

| | | |
|---|---|---|
| DE | 1230165 | 12/1966 |
| DE | 1815968 | 8/1969 |
| JP | 59-217417 | 12/1984 |

*Primary Examiner*—Thomas Mullen
(74) *Attorney, Agent, or Firm*—Maginot, Moore & Beck

(57) ABSTRACT

The invention relates to a flame-monitoring device in which an a.c. input voltage (U1) is limited to a voltage limit (U2) by means of a voltage limiter (4). Said voltage limit (U2) is applied to a flame sensing device (7) which operates by means of the rectifying effect of a flame, and through which a current (i) flows, especially when a flame (6) is present. An asymmetric voltage limit (U2) can be defined by said voltage limiter (4), said limit being then applied to the sensing device (7).

10 Claims, 3 Drawing Sheets

FLAME-MONITORING DEVICE

BACKGROUND

The present invention concerns a flame monitoring apparatus.

Such methods and apparatuses are already known for different purposes and uses. Thus for example DE-OS No. 1 815 968 discloses a flame monitoring apparatus in which an ac voltage is supplied to a transformer and subsequently to a peak voltage limiter. The transmission of voltage peaks from the mains to the operating circuit is prevented by the peak voltage limiter. The voltage limiters used for that purpose are for example voltage-dependent resistors (VDR) which provide a limiting effect in a bipolar mode, that is to say in both voltage directions. A problem of such flame monitoring apparatuses however is rectifier effects at the burner, which are not flame-induced, for example in the case of ionization electrodes due to chemical actions between the monitoring electrode and the reference ground. In limited situations however a flame signal can be simulated by those rectifier effects when a flame is not present. That can result in explosions in the burner installation, and for that reason the attempt is made to avoid the rectifier effects which are not flame-induced, by virtue of sufficient insensitivity in respect of the flame signal amplifiers.

One advantage of the present invention is to make flame monitoring apparatuses of the kind set forth in the opening part of this specification insensitive in relation to non-flame-induced rectifier effects, by suitable measures.

Therefore, one advantage of the invention is that an asymmetric limit voltage which acts on the sensor can be produced.

By virtue of the production of an asymmetric voltage, the negative effects of non-flame-induced rectifier effects with a high alternating current component, as can occur for example due to the deposit of cleaning agents or test sprays between the ionization electrode and the reference ground and for example mains voltages with an unwanted dc voltage offset can be better suppressed. In that way it is possible to avoid unwanted flame signals when no flame is present.

Further advantageous configurations of the invention are set forth in the appendant claims.

If semiconductor devices such as Zener diodes are used to produce an asymmetric voltage, it is possible even to cope with device faults in respect of the Zener diode, due to the higher number of Zener diodes in one direction. If a Zener diode fails there are still sufficient diodes for reliable operation of the voltage limiter. The greater the number of additional Zener diodes that are provided to produce the asymmetry, the correspondingly greater faults it is then possible to compensate.

The structure with Zener diodes does not exhibit any voltage dependency in comparison with varistors (with small series resistors) and temperature compensation can also be implemented by the use of Zener diodes with different temperature coefficients.

If the (unwanted) property of voltage dependency of varistors is to be simulated, that can be done by higher-resistance series resistors in the Zener diode series.

The structure with Zener diodes permits ac voltage stabilization with standard components which can be obtained from a number of manufacturers.

Implementation of ac voltage limitation by means of diodes, for example in the form of a diode section, also affords the advantage that, for example if it may be necessary that the limited ac voltage of an automatic firing device has to be switched over between two voltage values within a switching sequence, a voltage change-over switching operation can be easily implemented by bridging over some diodes of the diode array. In that case the desired voltage variation can be freely selected by way of the choice of the diodes.

In conventional voltage-dependent resistors (VDR) for voltage limitation, the voltage change-over switching procedure would require for example two varistors and a switch or a varistor, a voltage source and a switch.

BRIEF DESCRIFTION OF THE DRAWINGS

Further advantages will be apparent from the preferred embodiments of the apparatus according to the invention and the method according to the invention, which are described in greater detail with reference to the accompanying drawings in which:

FIG. 1 diagrammatically shows a flame monitoring apparatus,

DESCRIPTION

Figure 1:
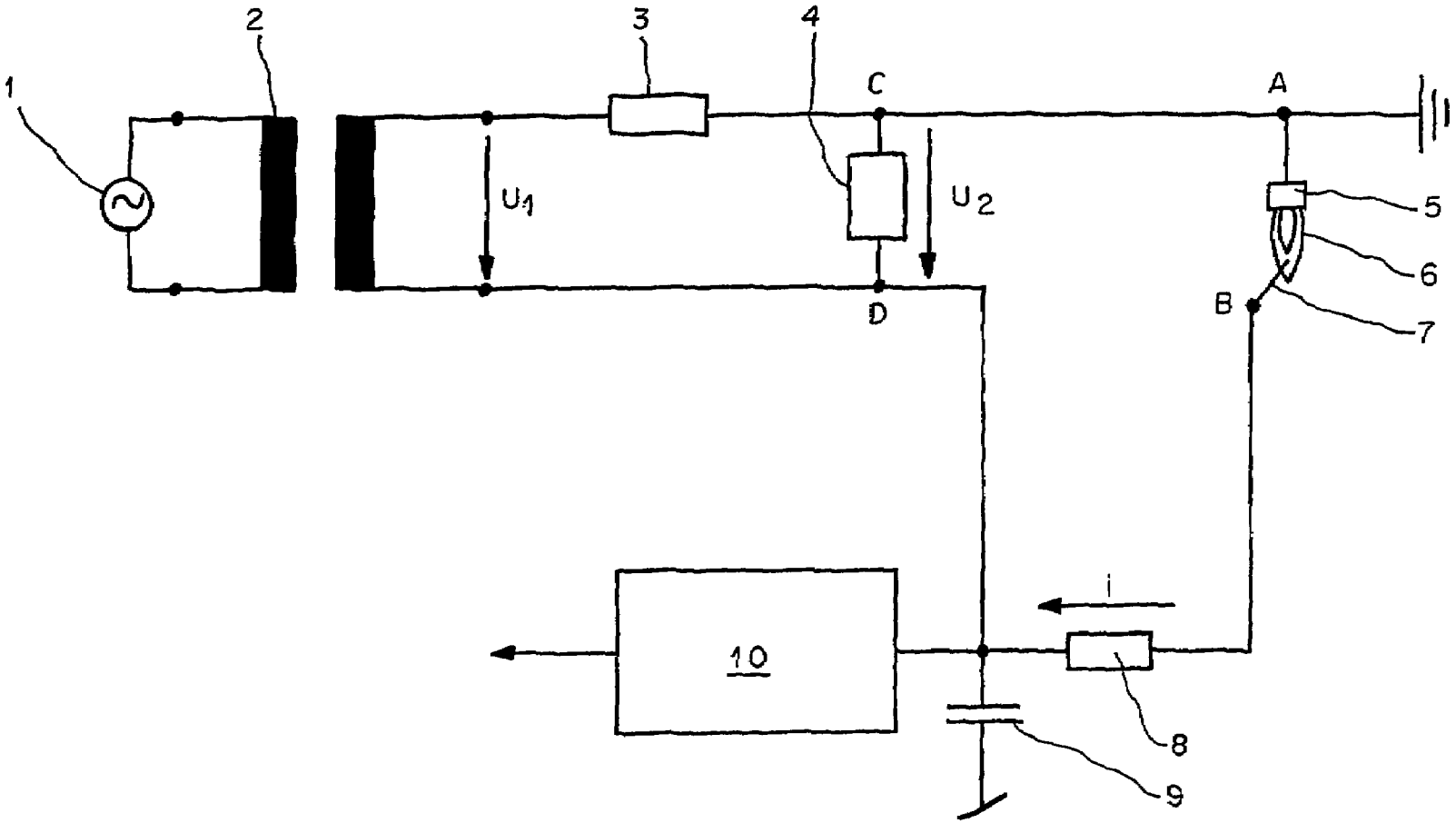
Figure 4A:
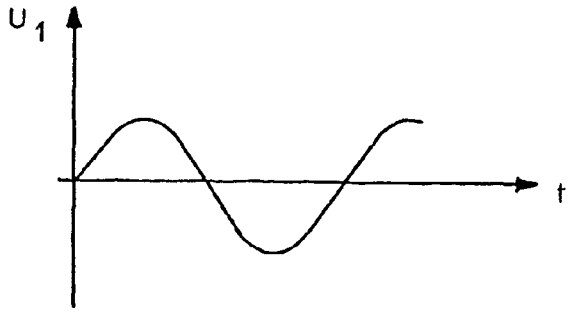
FIG. 4A shows the ac voltage at U1.

FIG. 1 diagrammatically shows a flame monitoring apparatus which is fed with an input voltage U1 for example by way of a mains ac voltage 1 and by way of a transformer 2. The behavior of the input voltage U1 is diagrammatically shown in FIG. 4A. The input voltage U1 is limited to the limit voltage U2 by way of a resistor 3 and a voltage limiter 4, see FIG. 4B.

A flame 6 can be produced by a burner 5. An ionization electrode 7 projects into the flame region of the flame 6. The ac voltage U2 is applied to the burner 5, and the ionization electrode 7. A rectified ionization current occurs due to the flame 6 and the applied ac voltage U2.

The ac voltage is filtered out by means of a low pass filter comprising a resistor 8 and a capacitor 9 and only the direct component which is used as a flame signal is passed to an amplifier 10 in which the flame signal is amplified and passed to a regulating device (not shown) for further processing.

Instead of the ionization electrode it is also possible to use a UV-sensor or any sensor which acts on the rectification effect of the flame amplifier signal. Under certain conditions those sensors also have undesirable rectification effects, for example with mains voltages with a dc voltage offset or in the case of certain defects in the sensors. Such sensors as well as the ionization electrode shown in FIG. 2 can be described by the equivalent circuits of FIGS. 2A and 2B in order to clarify the behavior thereof.

Figure 2A:
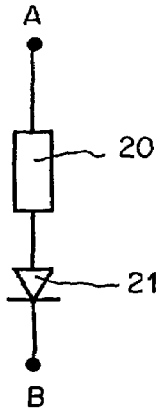
FIG. 2A shows an equivalent circuit for an ideal flame.

FIG. 2A shows the burner, illustrated in FIG. 1 between the points A and B, with the flame and the ionization electrode, in the form of an equivalent circuit for an ideal behavior with a diode 21 and a resistor 20 in series. The diode produces the same rectification effect as the flame.

Figure 2B:
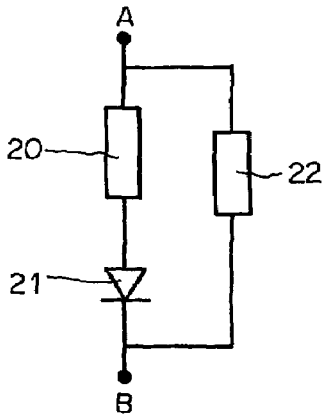
FIG. 2B shows an equivalent circuit for a real flame.

FIG. 2B shows the burner, illustrated in FIG. 1 between the points A and B, with the flame and the ionization electrode, in the form of an equivalent circuit for the real behavior with a diode 21 and a resistor 20 in series, with which a resistor 22 is connected in parallel. By virtue of that arrangement, current flows not only in the forward direction of the diode 21 but also in the reverse direction of the diode.

Figure 2C:
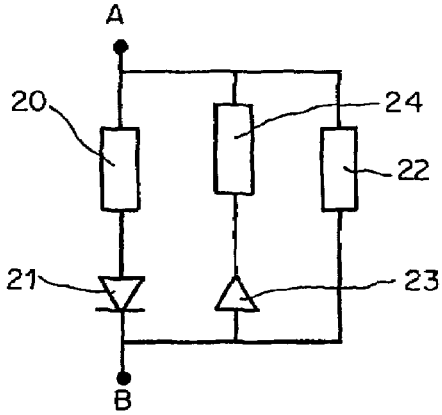
FIG. 2C shows an equivalent circuit for a contaminated electrode.

FIG. 2C shows the burner, illustrated in FIG. 1 between the points A and B, with the flame and the ionization electrode, in the form of an equivalent circuit for the real behavior in the case of a contaminated electrode with a diode 21 and a resistor 20 in series, with which a resistor 22 is connected in parallel and a diode 23 and a resistor 24 in series is connected in parallel.

Figure 3:
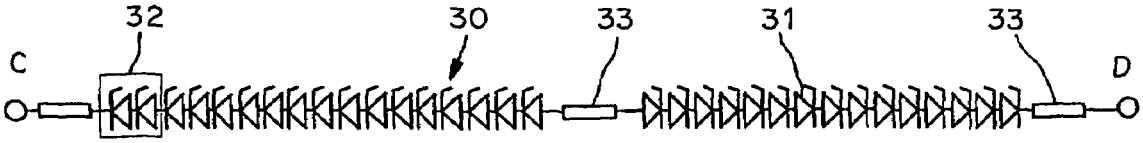
FIG. 3 shows an asymmetric ac voltage limiter.

FIG. 3 shows a voltage limiter according to the invention for producing an asymmetric voltage, comprising diodes 31 which conduct even in the reverse direction from a certain voltage on, for example so-called Zener diodes, in which respect additional Zener diodes 32 are so arranged in one direction that the voltage in the forward direction of the diode 21 is increased in relation to the voltage in the reverse direction. This means that a high current flows when a flame is present. The direction of installation of the voltage limiter is indicated from the points C and D which correspond to the points C and D in FIG. 1. The number of Zener diodes used is dependent on the respective situation of use and has to be specifically designed for each case. It is advantageous however for the asymmetry to be effected over two diodes in order not to involve a flame simulation even in the event of a possible duplicate defect.

For example a diode section for asymmetric voltage limitation to 342V can be implemented by means of 15 identical Zener diodes each of 22V (Uz=(15*22V)+(17*0.7V)=341.9V) and in the other half-wave for voltage limitation to 385V that can be implemented by means of 17 identical Zener diodes each of 22V (Uz=(17*22V)+(15*0.7V)=384.5V). The asymmetry can be limited to only 43V by the choice of 32 Zener diodes. The illustrated series resistors 33 are optional and serve for surge current limitation in the case of transient overvoltages.

The diode section should preferably be made up only by way of diodes of the same type and of the same value, that is to say the same breakdown voltage, in order to simplify defect consideration in the event of a possible short-circuit of one (or more) diodes. It is also advantageous only to use diodes from the same manufacturer in order further to reduce irregular defect probability.

Figure 5A:
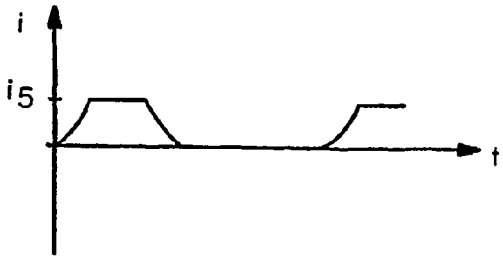
FIG. 5A shows the pattern of the current i with an ideal flame.

A current i is measured across the resistor 8 in FIG. 1. If the circuit for the ideal behavior as shown in FIG. 2A is incorporated into the circuit as shown in FIG. 1, that gives the behavior shown in FIG. 5A for i, with a maximum current of i5. That can be explained by the diode 21, by which the negative half-wave is cut off in the reverse direction.

Figure 5B:
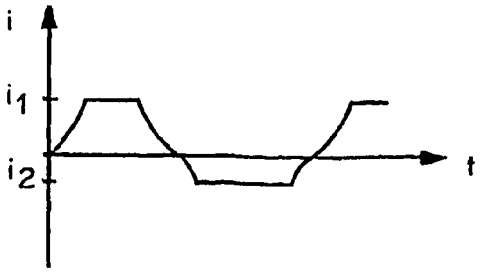
FIG. 5B shows the pattern of the current i with a contaminated electrode and asymmetric ac voltage.

If the circuit for the real behavior as shown in FIG. 2B is incorporated into the circuit shown in FIG. 1, that gives the behavior shown in FIG. 5B, with a maximum current in the positive direction of i1 and in the negative direction of i2. It also follows from the equivalent circuit shown in FIG. 2B however that i1 is greater than i5 (i1>i5) as the resistor 22 is additionally connected in parallel. Now however a current can also flow through theat resistor 22 in the negative half-wave, which current has its maximum at i2 but which in magnitude is smaller than i1.

Figure 4B:
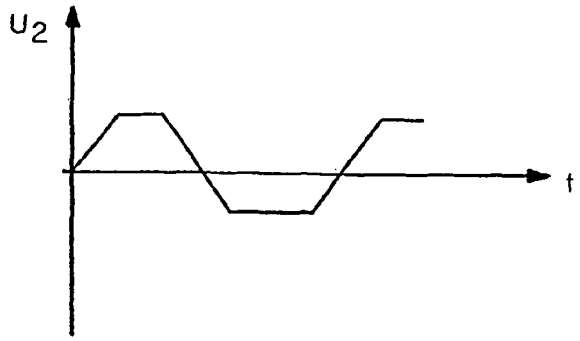
FIG. 4B shows the asymmetric ac voltage at U2.
Figure 4C:
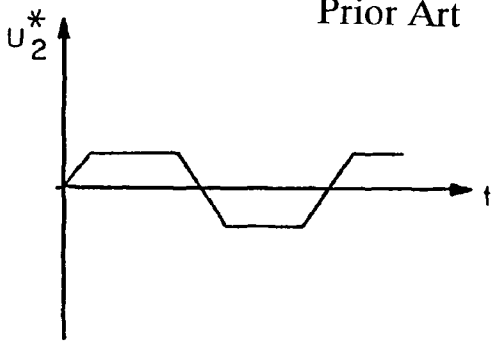
Fig. 4C Prior Art
FIG. 4C shows a symmetrical ac voltage U2* from the state of the art.
Figure 5C:
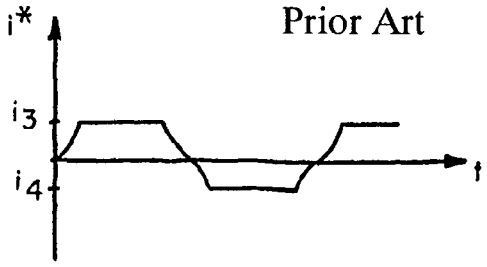
Fig. 5C Prior Art
FIG. 5C shows the pattern of the current i with a contaminated electrode and symmetrical ac voltage.

However the voltage limiter 30 gives rise to an asymmetric behavior in respect of the limit voltage U2, as can be seen from FIG. 4B. FIG. 4C shows a symmetrical voltage U2*, as is known from the state of the art and which is measured at the same measurement points C and D as the voltage U2. If, as already indicated above, the circuit for the real behavior as shown in FIG. 2B is incorporated into the circuit shown in FIG. 1, that, with the symmetrical behavior of the voltage U2* which is known from the state of the art, gives the behavior shown in FIG. 5C with a maximum current in the positive direction of i3 and in the negative direction of i4.

What is now crucial for the invention however is the fact that, with approximately equal i2 and i4 (i2=i4), i3 is smaller than i (i3<i1), that is to say the ratio of i1 to i2 is greater than the ratio of i3 to i4 ([i1/i2]>[i3/i4]).

That better ratio for an asymmetric voltage now makes it possible to use sensitive flame signal amplifiers, even if non-flame-induced rectification effects have to be suppressed, which permits better evaluation of the actual flame signal.

It will be appreciated that the invention is not limited to the embodiments described and illustrated.

The invention claimed is:

1. A flame monitoring apparatus in which an input ac voltage is limited to a limit voltage with a voltage limiter, wherein the limit voltage acts on a flame sensor through which a current flows when a flame is present, characterized in that the voltage limiter is operable to produce the limit voltage such that the limit voltage comprises an asymmetric limit voltage which acts on the sensor.

2. A flame monitoring apparatus as set forth in claim 1 characterized in that the voltage limiter comprises a plurality of limiter elements which symmetrically limit the voltage, and that in addition, to produce the asymmetry, at least one more limiter element is arranged, so that when a flame is present a higher current can be achieved than without asymmetry.

3. A flame monitoring apparatus as set forth in claim 1 characterized in that the voltage limiter comprises series-connected diodes which also conduct in the reverse direction from a reverse voltage on, that about half of the series-connected diodes are connected in the forward direction and the other half in the reverse direction, and in addition, for producing the asymmetry, in one direction there is at least one more diode, so that in the forward direction when a flame is present a higher current can be achieved than without asymmetry.

4. A flame monitoring apparatus, as set forth in claim 3 characterized in that the diodes are of the same type.

5. A flame monitoring apparatus as set forth in claim 1 characterized in that the sensor is an ionization electrode or a UV-sensor.

6. A flame monitoring apparatus wherein an input ac voltage is limited to a limit voltage, the flame monitoring apparatus comprising:

a flame sensor through which a current flows when a flame is present, wherein the limit voltage acts on the flame sensor; and a voltage limiter operable to produce a limit voltage that comprises an asymmetric limit voltage which acts on the flame sensor.

7. The flame monitoring apparatus of claim 6 wherein the voltage limiter comprises a first plurality of limiter elements which symmetrically limit the voltage and wherein at least one additional limiter element is arranged to produce the asymmetry, such that a higher current can be achieved when a flame is present than would be achieved without asymmetry.

8. The flame monitoring apparatus of claim 6 wherein the voltage limiter comprises an even number of series-connected diodes which conduct in the reverse direction from a reverse voltage, wherein a first half of the series-connected diodes are connected in the forward direction and a second half are connected in the reverse direction, and wherein in one direction there is at least one additional diode for producing asymmetry, such that in the forward direction when a flame is present a higher current can be achieved than without the asymmetry.

9. The flame monitoring apparatus of claim 8 wherein the series-connected diodes are of the same type.

10. The flame monitoring apparatus of claim 6 wherein the flame sensor is an ionization electrode or a UV-sensor.

* * * * *